US009149840B2

(12) United States Patent
Dahl

(10) Patent No.: US 9,149,840 B2
(45) Date of Patent: Oct. 6, 2015

(54) METHOD AND APPARATUS FOR MONITORING WEAR OF SHAKER SCREENS

(75) Inventor: Bjørn Dahl, Loen (NO)

(73) Assignee: OPTIPRO AS, Loen (NO)

( * ) Notice: Subject to any disclaimer, the term of this patent is extended or adjusted under 35 U.S.C. 154(b) by 831 days.

(21) Appl. No.: 13/120,137

(22) PCT Filed: Sep. 22, 2009

(86) PCT No.: PCT/NO2009/000329

§ 371 (c)(1),
(2), (4) Date: Mar. 31, 2011

(87) PCT Pub. No.: WO2010/033039

PCT Pub. Date: Mar. 25, 2010

(65) Prior Publication Data

US 2011/0180107 A1 Jul. 28, 2011

Related U.S. Application Data

(60) Provisional application No. 61/099,113, filed on Sep. 22, 2008.

(30) Foreign Application Priority Data

Sep. 22, 2008 (NO) ..... NO20084021

(51) Int. Cl.
*B07B 1/46* (2006.01)
*B07B 1/55* (2006.01)

(52) U.S. Cl.
CPC ..... *B07B 1/4627* (2013.01); *B07B 1/55* (2013.01)

(58) Field of Classification Search
CPC ..... B07B 1/4627; B07B 1/55
See application file for complete search history.

(56) References Cited

U.S. PATENT DOCUMENTS

| | | | | |
|---|---|---|---|---|
| 2003/0095250 | A1 * | 5/2003 | Kitagawa et al. | 356/237.1 |
| 2006/0016768 | A1 * | 1/2006 | Grichar et al. | 210/780 |
| 2006/0108113 | A1 * | 5/2006 | Scott et al. | 166/255.1 |

FOREIGN PATENT DOCUMENTS

| | | | | |
|---|---|---|---|---|
| EP | 1 254 738 | A2 | 11/2002 | |
| EP | 1 312 438 | A1 | 5/2003 | |
| JP | 63-207555 | A | 8/1988 | |
| JP | 6-23324 | A | 1/1994 | |
| JP | 2002-350353 | A | 12/2002 | |
| JP | 2002350353 | A * | 12/2002 | G01N 21/84 |
| JP | 2003-85311 | A | 3/2003 | |
| WO | WO 2006/112728 | A1 | 10/2006 | |
| WO | WO 2007/045922 | A1 | 4/2007 | |

* cited by examiner

*Primary Examiner* — Joseph L Perrin
*Assistant Examiner* — Levon J Shahinian
(74) *Attorney, Agent, or Firm* — Birch, Stewart, Kolasch & Birch, LLP

(57) ABSTRACT

An apparatus for cleansing and monitoring wear of screen cloths includes a feeding device for feeding used or contaminated screen cloths to, a cleansing unit arranged for receiving and cleansing the screen cloths, a preparation unit arranged for preparing the screen cloth for optical inspection in, an optical inspection station arranged to identify one or more damaged portions of the screen cloth and with a registering device for registering positions for the damaged portions, a measuring device for measuring and registering an extent of the damaged portions extent and degree of damage, a repair unit arranged for mending the damaged portions, and a feeding out unit for feeding out said repaired screen cloth.

27 Claims, 6 Drawing Sheets top screen and primary screen

METHOD AND APPARATUS FOR MONITORING WEAR OF SHAKER SCREENS

This application is a National Phase of PCT/NO2009/000329 filed on Sep. 22, 2009, which claims priority under 35 USC 119(e) to U.S. Provisional Application No. 61/099,113 filed on Sep. 22, 2008 and under 35 USC 119(a) to patent application No. NO20084021 filed in Norway on Sep. 22, 2008. All of the above applications are hereby incorporated by reference into the present application.

INTRODUCTION

The present invention relates to drilling mud/particle separator screens or so-called "shaker screens" used during drilling boreholes for petroleum exploitation. More specifically, the invention relates to a method and a device for cleansing a shaker screen used in a drilling mud/particle separator, inspecting the shaker screen, identifying and registering significant wear on the shaker screen and repairing the shaker screen if significant wear is present, and returning the shaker screen for further use in borehole drilling.

Drilling of petroleum wells is conducted in that the drilling string is hollow and transports drilling liquid down to or in to a drill bit with nozzles. The drilling fluid returns with drilled out formation rock mass in the form of cuttings, rock particles, sand and metal particles back to the surface. The drilling liquid has high density and may be tixotropic or not, in order to bring along particles and cuttings back via the annulus and out of the borehole. The drilling liquid as such is an expensive liquid, it shall to a smallest, degree possible be released, and shall to a largest degree possible be recuperated. On the surface the drilling liquid and the cuttings via the primary separator plant normally comprising vibrating or rotating screen cloths.

Figure 1:
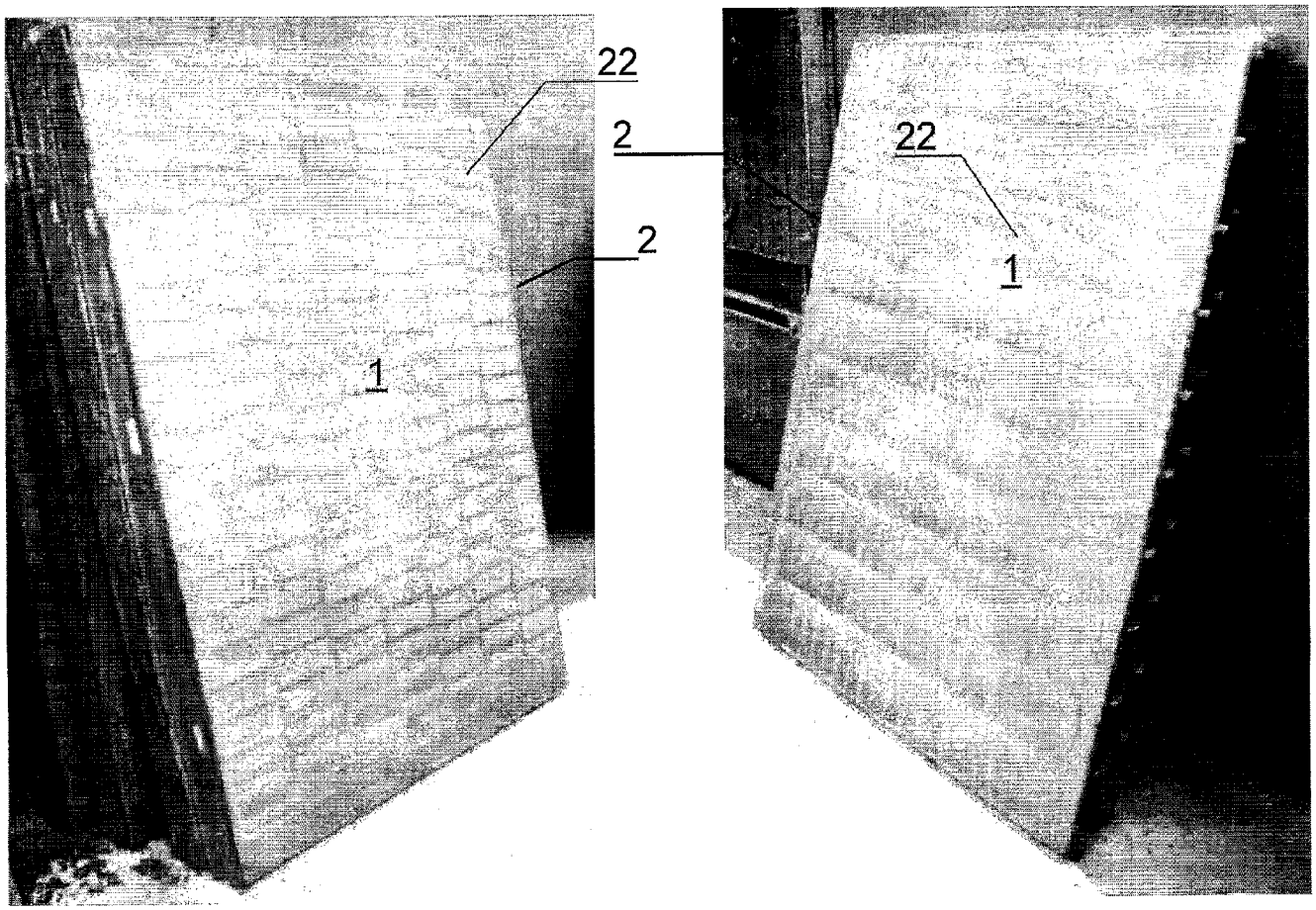

Vibrating screen cloths (1) are used in so-called "shakers" for catching and vibrating out laterally that portion of the returning drilling mud or drilling liquid which is constituted by cuttings, sand and metal particles, and letting the drilling mud as such pass filtered through the screen cloth. The drilling mud is led over a series of one or more screen cloths (1), the coarser first, which removes the coarser particles, and later over finer and still finer screen cloths (1). Examples of such screen cloths arranged in frames are shown in FIG. 1.

The entire screen assembly is vibrated in order to make drill cuttings and particles of all sizes to migrate out across the edge of the shaker screen frame so as for the drilling liquids liquid fraction and finer particles, below the shaker screen's mesh size will pass through the screen cloth. There are also screen cloths (1) arranged as an endless band which are arranged for rotating slowly. A shaker screen may comprise a rectangular main frame (2) of about 1×1 $m^2$ and an example is shown in that the main frame may have 10 rows each of 20 rectangular oblong cell frames (22) each supporting its portion of a screen cloth.

Most shaker screen frames (2) comprise an upper screen cloth (1) with the desired mesh size, e.g. from 2500 gm (2.5 mm) for the very coarse screen, and down to 20 μm (0.020 mm), all with a backing of a support cloth with mesh size of between 2500 μm (2.5 mm) or 2000 μm (2.0 mm) or even 1000 μm (1.0 mm) which are all rather rough and durable. The screen cloth (1) and the support cloth (11) may be fixed to the cell frames (22) by means of adhesives or hardening cement mass so as for the screen cloth and the support cloth not to mutually vibrate and grind and thus to prevent that the screen cloth from be worn over the cell frame, and further prevent that the support cloth from being worn against the cell frame.

The so-called "cut point" of the screen cloth is defined by the size of the particles which have a given probability for being removed in a filter. Usually cut points may be indicated such as "$D_{50}$ 500" and "$D_{90}$ 500" defining 50% og 90% probabilities of being removed for particles of a given size, here 500 μm. For particles larger than the indicated "cut point" the probability for the particle to be sorted out is larger. For particles os a size less thann the indicated "cut point" the probability is larger to pass through with the mud.

Problems to be Solved

A screen cloth initially has a given "cut point" which indicates the mesh size distribution of the apertures of the screen cloth, and indirectly indicates which size of particle sized which may pass through the apertures of the given mesh size distribution. The particle size distribution (PSD) affects the drilling liquid's properties and has an influence for example with regard to how far one may drill with the different borehole diameters, related to, among other factors, liquid pressure and resistance forces on the drill string such as torque. An article in the publication of the Society of Petroleum Exploration, SPE103934 "Successful Drilling of Oil and Gas Wells by Optimal Drilling Fluid Solids Control—A Practical and Theoretical Evaluation", by B. Dahl, A. Saasen and T. H. Omland, describes disadvantages of wear of screen cloths.

A significant problem is that the screen cloth, which shall only let through a desired particle size, is worn and holes formed, and thus the screen cloth lets through particles as coarse as will be let through the support cloth, which in this example may be a standard mesh of 1000 μm. Thus the returning drilling liquid the desired particle size distribution and the desired maximum particle size for the further drilling operation. This is a known problem and the drilling programme is set up with the limitation which one knows in advance will come which are incurred by the particle size distribution becomes wrong, that is, too coarse due to open holes (h) in lesser or larger proportions in the screen cloths. This incurs that the drilling process is not as good as would otherwise have resulted if the particle size distribution according to the filters used and their nominal values were actually achieved.

The screen cloths' properties throughout the drilling process according to current practice are not registered. Thus the actual temporal development of the cut point of the screen cloth is unknown, and thus also not the quality of the primary separation of the drilling liquid. As an example of through flux by different cut point sizes one may envisage a screen cloth with a cut point of $D_{50}$ 74 μm with a backing of coarser support cloth of $D_{50}$ 1300 μm, such as illustrated in FIG. 3*b*. The maximum particle size which is allowed to pass through the backing cloth (11) has a volume which is about $1300^3$ divided by $74^3$ which is about 5400 times larger than the particle size which should be allowed to pass through the screen cloth (1). A hole in the screen cloth resulting in that only the backing cloth (11) remains in the damaged part would incur not only that larger particles flow through than what the screen cloth nominally should stop, also a larger liquid volume will flow through the shaker screen frame, incurring in total that the amound of the undesired particle sizes increases far more than the area proportion of the damaged screen cloth as such of the shaker screen frame.

In summary, the above problems incurred damaged screen cloth in relation to the quality of the resulting drilling mud, particles of too large size are allowed through the damaged shaker screen. Further, the amount of liquid containing too large particle size distributions is larger in proportion than the proportion of damaged screen cloth of the shaker screen.

Another significant problem in that holes are formed in the screen cloth is, that if the screen cloth by a given number of defect cells have open holes, the shaker screen frame must be disposed of and replaced. A shaker screen on a frame costs about 800 US$ and may be consumed in large numbers during a drilling operation of one well. It is difficult to repair a shaker screen on the drilling location if the shaker screen within an entire cell is torn up, but small holes which comprise less than the size of one cell, may be sealed with glue or flexible cement and thus prevent further damage. However, according to the knowledge of the inventor, no system exists which systematically handles problems related to open holes in screen cloths, or any apparatus for automatically repairing screen cloth damages, nor any systematic method for registering the individual histories of used screen cloths during one or more drilling operations. Repair of screen cloths according to present practice is done to a varying degree on the drilling location by use of particularly adapted plugs, glue (single and composite), or silicone based flexible mass. The mending task may constitue a health risk to the operator. The excess man hours required while drilling the larger dimensions such as 24 inches and 17.5 inches may be between 4 and 8 hours in order to keep pace with the development of screen wear while drilling about 3 $m^3$ of rock mass volume per used shaker screen. The upstream face of the screen cloth (1) is worn due to the impacting or migration of cuttings and particles, but also the downstream face of the screen cloth (1) is worn. The downstream face is worn due to grinding by particles but also due to grinding against the support screen (11) within the cell frames (22) which is vibrated against each other. Empirically one knows that the screen cloth takes place from both sides of the screen cloth (1) both in that a wear by particles occurs on the free upper surface of the screen cloth (1) and due to wear from the support cloth (11) or the frame cell's (22) sub-frame (23) against the underside of the screen cloth's surface, until one or more wires in the screen cloth (1) breaks.

SHORT FIGURE CAPTIONS

Screen cloths, problems related to such screen cloths and their wear, and embodiments of the invention as such are illustrated in the attached drawings. The drawings are meant to illustrate the invention but not to limit the invention.

Figures 1B, 1C, 1D, 1E, 1F, 1G, 1H:
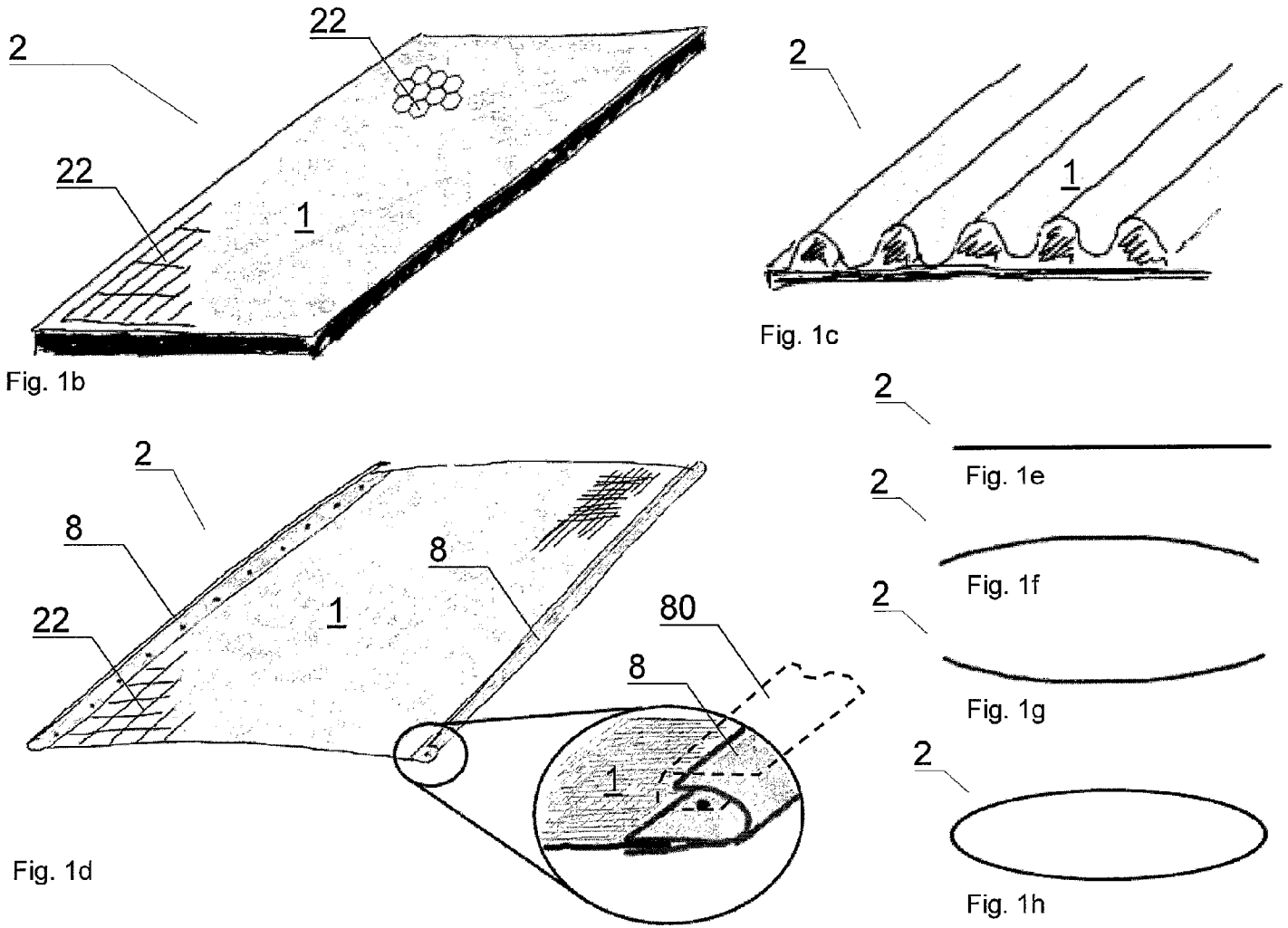

FIG. 1 shows photographic images of different kinds of stored so-called shaker screens for use in vibration separators. Crude screens (top screens) are shown to the left, and so-called primary screens or screen cloths (1) in frames are shown to the right. Such a frame may comprise 10×20 rectangular cells. The cells may also have other shapes such as hexagonal. FIG. 1*b* illustrates background art with a screen frame with a screen cloth, here shown with rectangular and alternative hexagonal cells. FIG. 1*c* illustrates a bacgfround art so-called pyramid screen. FIG. 1*d* shows a hook strip screen with rectangular cells that may be made in epoxy or similar material, or an extensive screen cloth without subdivision into cells. A detail is shown of the hook strip edge. FIGS. 1*e, f, g*, and *h* illustrate flat frame screen, convex frame screen, concave frame screen, and rotating screen for use in separator machines in primary separation plants.

Figure 2:
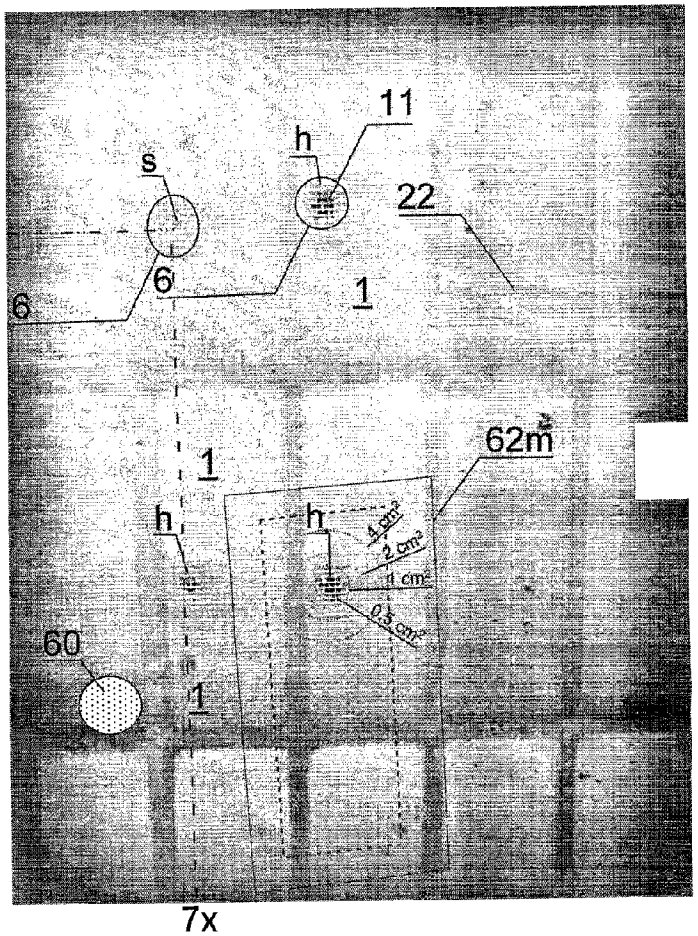

FIG. 2 is a photographic image of a screen cloth (1) in a frame (2) in which the screen cloth in about 40 of the 200 cells is entirely or partially damaged such that the screen cloth (1) with the frame (2) is defect and must be disposed of.

Figure 3:
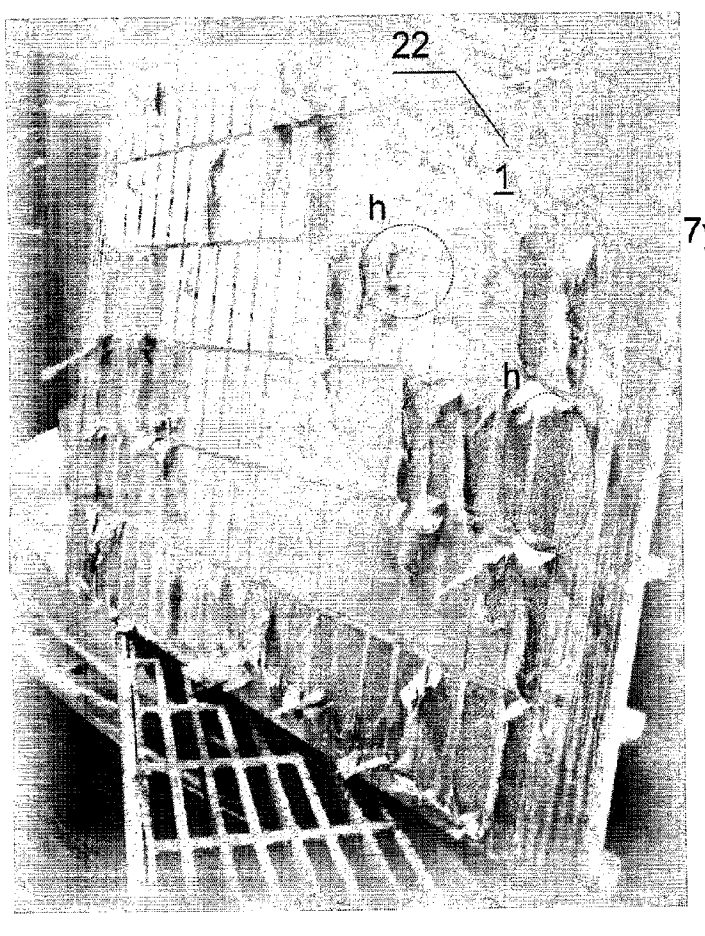
Figure 3B:
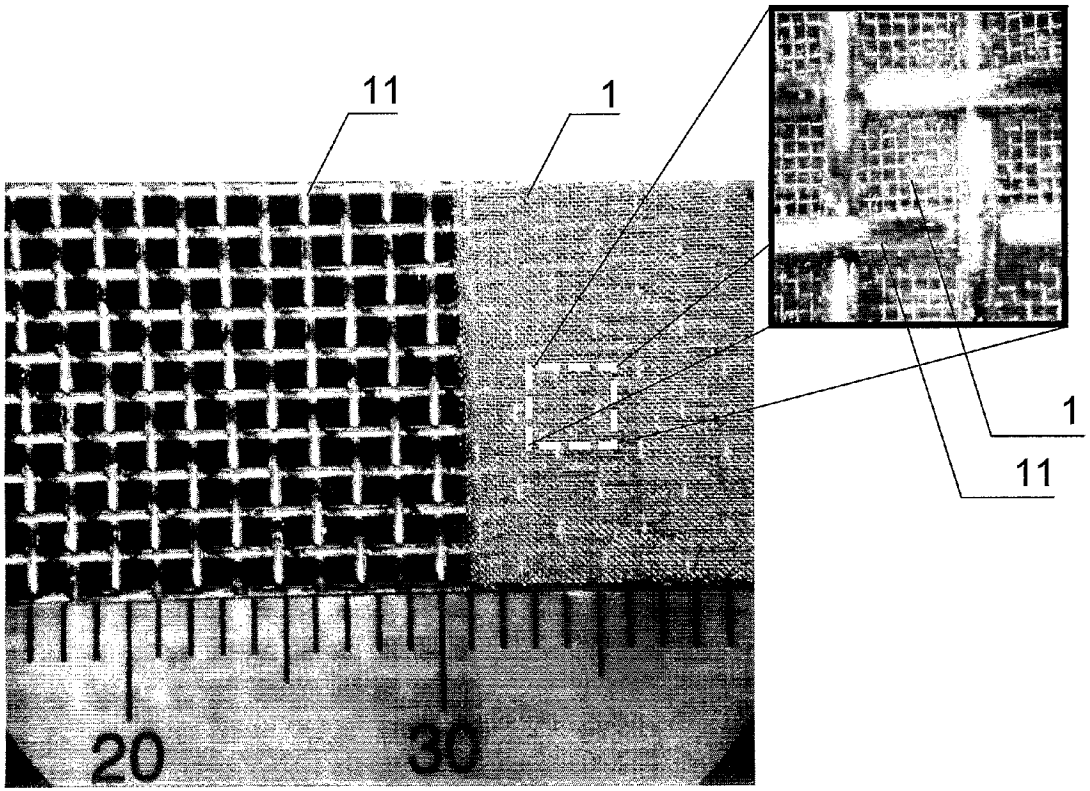

FIG. 3 is a photographic close-up image of cells (22) in a generally intact screen cloth (1) under good particle control, so-called "solids control", whith some wear portions (s) and open wear holes (h) and a repaired portion (60), and a hole template (62*m*) for manual use in an embodiment of the invention. FIG. 3*b* shows close-up images of support cloth (11) and screen cloth (1) for indicating the reduction of the property of being able to separate out small particles which will be incurred by an open hole in the screen cloth.

Figure 4:
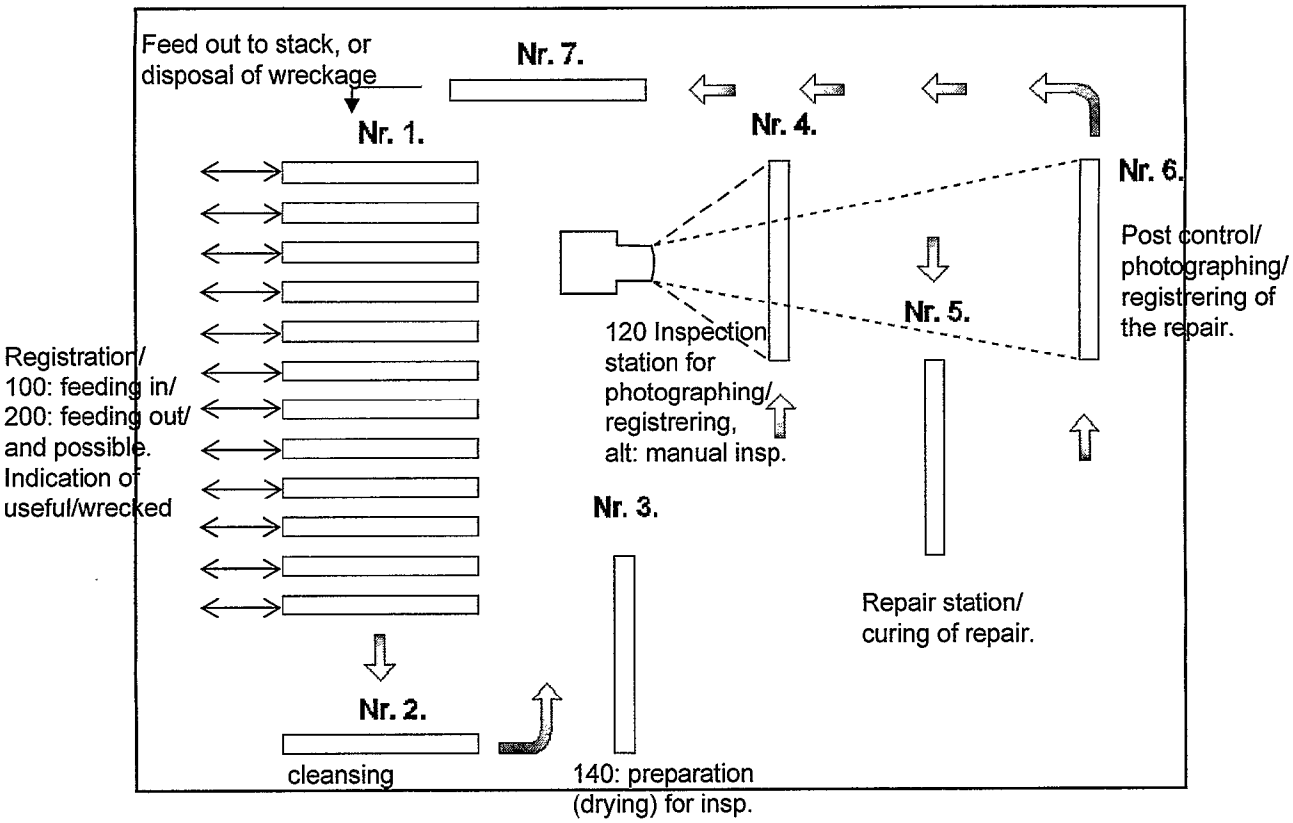

FIG. 4 is an illustration of the process according to the invention for feeding in used, mud contaminated screen cloth frames (1, 2), cleansing the screen cloth, inspecting the screen cloth for wear and possible damages, registering the damages and the wear state of the screen cloth, reparing registered damages of the screen cloth, checking the repairs, and feeding out the intact or repaired, registered screen cloth frame (1, 2).

Figure 5:
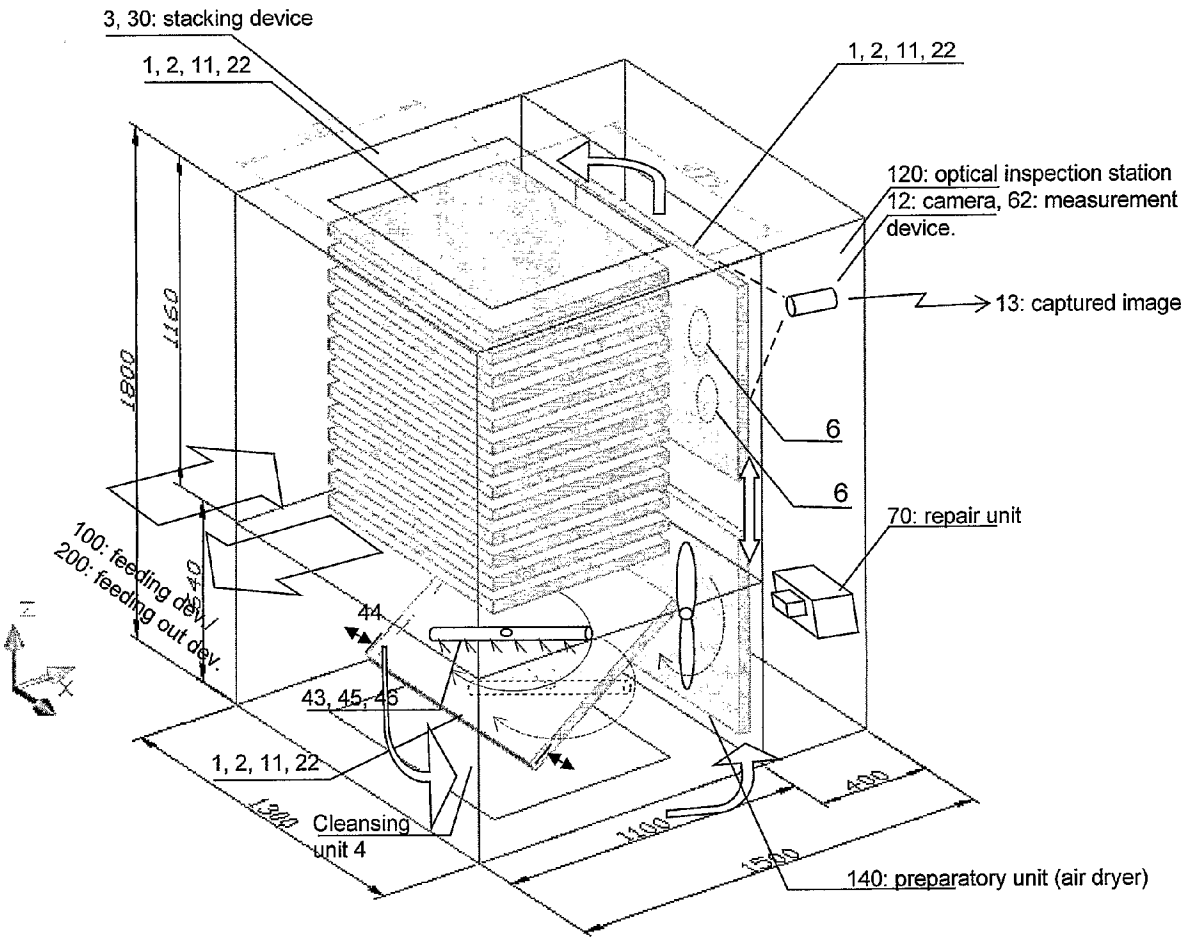

FIG. 5 is a rough sketch of the apparatus of the invention for feeding, cleansing, inspecting, registering, repairing, controlling and feeding out of screen cloths (1).

DESCRIPTION OF PREFERRED EMBODIMENTS OF THE INVENTION

The invention comprises an apparatus for cleansing screen cloths (1) and monitoring wear of such screen cloths (1), comprising:

A feeding device (100) is arranged for feeding in used or dirty screen cloths (1) or screen cloth frames (2) to a cleansing unit (4). The screen cloths (1) are usually made of steel mesh but may be made in other materials such as composite fibre cloths. The feeding unit may comprise actuators, sheaves and guide rails arranged for displacing and guiding frames (2) with screen cloths (1) from a stack (3) to the cleansing unit (4). The cleansing unit is arranged for receiving and cleansing the screen cloth (1). The aparatus comprises a preparation unit (140), preferably an air blower dryer, arranged for preparing the screen cloth (1) for optical inspection in an optical station described below. the dryer may comprise a fan or a pressurized-air nozzle arranged for blowing air onto the screen cloth. Alternatively, the inspection or the photographic image capture may take place with the screen cloth submerged in a tank with transparent liquid so as for avoiding having to dry the screen cloth before the inspection.

The optical inspection station (120) for the screen cloth (1) may be manual or automatic. In the automatic embodiment of the invention the inspection station is arranged for identifying one or more damaged portions (6) of the screen cloth (1), and registration of one or more of the damaged portions (6) position (7, 7*x*, 7*y*). In a preferred embodiment of the invention the optical inspection station (120) comprises a measurement device (62) for measuring and registration of the extent and possible degree of damage of one or more of the damaged portions (6). A subsequently arranged repair unit (70) is arranged for patching or mending one or more of the damaged portions (6) and possibly for registering the extent of the so repaired previously damaged portions (6, 60). The registration of the repaired portions extent may also take place by a post check in the optical inspection station (120).

The invention comprises in a preferred embodiment a feeding out device (200) for feeding out the repaired screen cloth (1) from the repair unit (70), possibly indirectly via the inspection station (120) to a stack station (30) with a stack (3) comprising cleansed, repaired and checked screen cloths (1). In a preferred embodiment of the invention these fed out screen cloths' repaired portions and new properties are registered together with an identifier associated with the screen cloth (1), preferrably in an identifier tag in the frame (2). The screen cloth may also be so-called "frameless", i.e. that the screen cloth (1) may be arranged for being attached in the vibrating shaker apparatus along two or more edges (8), e.g. by so-called "hook strip"-edges, please see FIG. 1*d*, by means of corresponding edge holders (80).

In a preferred embodiment of the method according to the invention the screen cloth (1) is fed in from a stack station (3) of such screen cloths (1). After cleansing, inspection, registering and repair, the screen cloths are fed out to a stack (30) of such screen cloths (1), preferably to the same stack station (3) from which the used, contaminated screen cloths were stored initially. In this way the clean, repaired screen cloths (1) will reappear in the same stack station which they were stacked into the apparatus. An indicator device in the apparatus may indicate which screen cloths which are useful for further mud filtration and separate those from such screen cloths which should be disposed, by marking or displacing useful screen cloths from disposable screen cloths, or feed out screen cloths to be disposed separately to a separate feed-out stack.

Manual Observation and Measurement

In a practical embodiment of the apparatus according to the invention the optical inspection station (120) is arranged for an operator to conduct the inspection of the screen cloth (1) with the eye, and forther be arranged so as for enabling the operator to conduct a manual measurement of the one or more damaged portions (6) extent and position (7), and register this information. The position (7) may comprsie two coordinates (7*x*, 7*y*) which are orthogonal. According to the invention the manual measurement of the one or more damaged portions (6) extent be conducted by means of a so-called hole template (62*m*) such as is illustrated in FIG. 3. Such a hole template is mentioned in SPE103934 but not described. The hole template (62*m*) is transparent and comprises a series of consentric circles (or ellipses or rectangles) with given areas, of which said consentric circles are indicated with their respective areas and arranged for being overlaid onto the damage or the open hole (6) and thereby indicates the area of the damaged portion (6) and its status, such as the degree of wear or open hole, and its position (7, 7*x*, 7*y*).

Such data may then be registered together with the borehole depth or the drilling interval during which the screen cloth (1) has been used, and the identifier of the screen cloth, such that one may monitor the development (or degradation) of the screen cloth (1) during the drilling process. Carriers for such identifiers may be such as an RFID-tag (which is known per se) which may be arranged on the frame (2) or otherwhere in connection with the screen cloth (1), said RFID-tag being arranged for following along with and identify the screen cloth (1) on demand from corresponding RFID-equipment arranged in apparatuses in which the screen cloth (1) passes. Possibly the RFID-tag may store data about the screen cloth (1) and its frame (2) and the condition of the screen cloth (1). One may take the screen cloth (1) out of the critical line of use if its actual cut point or actual particle size distribution no longer satisfies given criteria.

Instrumental Observation and Measurement:

The invention comprises in a preferred embodiment an automatic apparatus as illustrated in FIG. 5, in which the optical inspection station (120) is provided with a camera (12) arranged for making image captures (13) of at least one or more of the damaged portions (6) and storing those image captures (13) in a camera memory (14), and a computer with an algorithm arranged for storing the camera image capture (13) in the memory of the computer. Devices for conducting image captures (13) and storing such in the camera memory (14) and for analysing the image given that one knows she detail structure of what is sought in the image, such as searching for a given range of mesh size in an image and discriminating between a mesh size belonging to a screen cloth (1) and another mesh size belonging to a backing cloth (11) and calculating the areal extent of a disclosed area of backing cloth (11) and its position (7, 7*x*, 7*y*) is a task for an image analysing engineer; such equipment is known per se.

The camera (12) may be an area camera capturing the entire or part of the area of the screen cloth (1), or a line camera arranged for scanning line by line of the screen cloth and reconstructs an image of the area of the screen cloth (1) in the camera memory (14) or in an algorithm for reconstructing the image in a computer memory (9). In a preferred embodiment of the invention the algorithm for the registration under step (c) with registering of the one or more damaged portion's (6) position and step (e) registering of the one or more damaged portions (6) extent and degree of damage make the calculations in the computer and the registration of the calculated data to the computer memory (9).

The algorithm may generally identify intact screen cloth (1) and cell frame, either based on colour, grey tone or even actual optical measurement or image analysis of the image to get hold of the mesh size or wire thickness if the camera resolution is sufficiently high. Departures from intact screen cloth (1) will be a worn screen cloth (1) or an open wear hole, identified e.g. by finding an area and intensity of entirely or partly visible coarse mesh support cloth (11) in or behind the screen cloth (1). The algorithm may work with detecting and calculating the limits of worn portions and wear holes. The apparatus' algorithm for measuring and registering of the one or more damaged portions (6) degree of wear may also be arranged for calculating the degree of damage of the damaged portion (6) and possible broken cloth. The algorithm may further be arranged for calculating the cut point curve or particle size distribution after the repair has been made.

The method according to the invention may in a preferred embodiment comprise measurement of the damaged portion's (6) extent and shape in the form of measuring of the damaged portion's (6) diameter or area, and if required also the shape of the damaged portion's (6) circumference. According to a preferred embodiment of the method under item (c) with registration of the one or more damaged portion's (6) position (7) and (e) registration of the one or more damaged portion's (6) extend and degree of wear or damage, the measurements will be conducted and sent directly or indirectly to a computer memory (9) for storage. These data may be stored so as for being related to a frame number or other identifier for the frame (2) and real time well data such as the actual drilling depth interval. In a preferred embodiment of the invention these data may be stored using the RFID-equipment above.

The Cleansing Unit

In a preferred embodiment of the invention the apparatuses' cleansing unit such as mentioned under step (b) arranged for cleansing of the screen cloth (1), is provided with a nozzle (43) arranged for flushing cleansing liquid or steam towards at least the upper and preferrably also the lower face of the screen cloth (1) or shaker screen frame (2) with screen cloth (1). In practice the drilling liquid which is released from the screen cloths also have to be flushed away from the inner face of the enveloping cleansing station. The cleansing station may be arranged for arranging the screen cloth (1) or shaker screen frame (2) in an inclined positon, such as illustrated in FIG. 5, during the flushing and cleansing process so as for dirt and remnants of cuttings may run off the screen cloth (1). The apparatus according to the invention is preferrably provided with a vibrator (44) arranged for vibrating the screen cloth (1) during the flushing and cleansing process in order to improve the cleansing process. The screen cloth with its frame (1) is designed for operating under vibration in its assigned use for separating drilling mud and cuttings and will thus hardly be further damaged or worn during the vibrations of the cleansing process.

As illustrated in FIG. 5 the apparatus according to a preferred embodiment of the invention is arranged so as for the flushing unit (43) comprises at least a rotating beam with flushing nozzles (46) directed at least toward one face of the screen cloth (1), preferrably both sides.

The Process According to the Invention

According to the invention the process for cleansing, repair and registration of the finally repaired screen cloth (1) for monitoring wear of the screen cloth (1) is conduced by:

a) The apparatus feeds forward a dirty screen cloth (1), preferably from a stack, but alternatively manually from the outside.

b) Feeding in the dirty screen cloth (1) and cleansing of the screen cloth (1) in a cleansing unit (4).

c) Preparing the screen cloth for optical inspection after cleaning, preferrably by drying so as for at least a superficial water film to be removed to a sufficient degree is removed before the optical inspection is conducted.

d) Optical inspection of the screen cloth (1) is conducted in the optical inspection station (120) for identifying one or more damaged portions (6) of the screen cloth (1), and registration of the one or more damaged portions (6) position (7). This may be conducted by manual and visual inspection by an operator but may also be conducted using a photographic camera.

e) Measurement and registration of the one or more damaged portions (6) extend and degree of wear and damage. The measurement may be conducted by analysing the image in a computer using a specialized algorithm for detecting intact screen cloth and discriminating it from worn or absent screen cloth.

f) Repair of the one or more damaged portions (6) and registration of the repaired portions (60) extent, also here either manually by an operator or automatically, preferrably in the inspection station (120). In the inspection station the inspection may check that all required repair actually has been conducted and that the repaired area or areas (60) actually coincide with the positions (7) of the damaged portions (6). Under this step the analysing algorithm may verify that the repair has been conducted with a proper result, and may on the basis of the repairs and the remaining intact cells with intact screen cloth (1) calculate new cut point parameters or particle size distribution for the cleansed, worn and possibly repaired screen cloth (1) for the entire shaker screen frame (2). Important here may be to calculate the new and possibly reduced volume capacity of the entire shaker screen frame (2) as one may have replaced damaged screen cloth (1) of one mesh with another screen cloth (1) of somewhat different mesh, affecting both cut point and PSD for the entire shaker screen frame (1).

g) Feeding out the cleansed, inspected and possibly repaired screen cloth (1). Preferrably the screen cloth (1) is fed out to a stack (3) comprising shaker screens cleansed and ready for further use. A combined feeding in transport device (100) and feeding out transport device (200) in the stacking device (30) may be arranged for feeding in screen cloths (1) one by one to the cleansing station (4) such that the stacking device (30) may receive the cleansed, inspeced and possibly repaired screen cloths (1) back to available free slots in the stack (30).

In a preferred embodiment of the method according to the invention one may during one or more steps (f) with repairing one or more of the damaged portions (6) and registering of the repaired portions (60) patched or otherwise repaired or replaced areas, as the patch may comprise screen cloth, measure and register the area of the repaired portions (60) patched or replaced area (both from the current process and from previous repair processes conducted on the same screen cloth (1) or shaker screen frame (2), and thus calculate the remaining, intact proportion of the screen cloth (1). When these data are registered together with the screen cloth's (1) or shaker screen frame's (2) frame number or other identifyer, together with the actual drilling depth interval drilled, lithology, etc., obtain an insight into the screen cloth's (1) drilling history and development of its properties such as cut point and PSD over time, and may relate those to the drilling progress. The operator may futher have an indication to how long the shaker screen may last during its use in the separator during the drilling process. Based on this information and the history of comparable screen cloths (1) or shaker screen frames (2) the operator will obtain good indication to how long the screen cloth may last and at what point of run-time it should be taken out of use for a new general repair or scrapping. The method may during step (f) with registration of the repaired portions (60) extent register real-time data from the drilling process, such as in which time interval the damage (6) occurred, or which drilling depths in the well that the screen cloth (1) has been used when the damage occurred, the circulation rate, the rotational speed for the drill string, the weight on bit, and the rock type. As such the method of the present invention may provide valuable data for higher order drilling monitor processes on the drilling platform so as for enhancing the drilling progress.

In the method according to the invention it may be advantageous, for the step of measuring and registering the repaired portions (60) state and exent, to transfer the screen cloth (1) to the optical inspection station (120) such as indicated in FIG. 4 and FIG. 5.

The apparatus according to the invention is, in other words, an industrial washing machine for relatively fine mesh screen cloths (1) used for separating drill cuttings from drilling liquid or drilling mud during a well drilling process. The drilling process may use rather low density drilling slurry-like liquids such as early after setting the riser and the BOP, or higher density drilling liquids such as used when high well pressure may be encountered. The machine according to the invention is arranged for washing and drying screen cloths (1), for inspecting for wear and damage, for repairing possible damages or holes, for inspecting the screen cloth after possible repairs, and in a preferred embodiment for storing the repair data and relate those data to the identifier of the screen cloth's frame number and the actual drilling depth interval of use, and for returning the cleansed, possibly repaired screen cloth for further use.

Thus the apparatus and the method according to the invention may contribute not only to clean screen cloths used in the drilling process, but also for detecting wear and damage at a given time during the drilling process, measure the extent of the damage, repair the damage to an acceptable degree before the extent of the damage may increase to an undesired degree or in an uncontrolled manner, and possibly take out shaker screens which no longer may contain or separate the drilling liquid in a proper way. During drilling processes using screen cloths in the way used in industry practice a rough estimate of the duration of a shaker screen may be about 3 $m^3$ theroretically drilled well volume per shaker screen before it has been afflicted 20% damage or reduction of its capacity.

In a drilling process which has been conducted using a manual experimental embodiment of the method according to the invention, in which systematic observation, measurement and registration of wear and open holes of the screen cloths have been conducted, and in which open holes have been repaired, and in which an account has been made over the screen cloths' remaining intact area, the duration of a number of 25 applied screen cloths have been increased to about 1200 $m^3$ filtered, theroretically drilled out well volume per shaker screen frame, and no screen frames had to be disposed of. In this way the invention to a large degree solves the problems of the background art related to wear and damages to screen cloths, and contributes significantly to reduction in the consumption of screen cloths during drilling petroleum wells. The method and the apparatus according to the invention contributes to actually register the real conditions related to the actual cut point and PSD for the controlled and repaired screen cloths and thus the quality of the primary separation, which in the bacground art is not actually taken care of. Indirectly the apparatus and the method of the invention reduces the wear of the shaker screen and may thus contriubute to improve the drilling progress and increase the degree of predictability to complete the predefined drilling schedule within a given time and budget.

The invention claimed is:

1. An apparatus for cleansing and monitoring wear of used or contaminated screen cloths used in a petroleum drilling process comprising:

a housing accommodating a stacking station, a cleansing unit, a preparation unit, an optical inspection station and a subsequently arranged repair unit, wherein:

the stacking station is configured to stack screen cloths in a stack, said stacking station including a plurality of stacking racks configured for storage of more than one of said screen cloths, a combined feeding in transport device and feeding out transport device is configured to feed in said screen cloths one by one from the stacking station to the cleansing unit, said combined feeding in transport device and feeding out transport device comprising actuators, sheaves and guide rails configured to displace and guide frames with screen cloths from said stacking station to the cleansing unit, said cleansing unit is arranged for receiving and cleansing said screen cloth;

said preparation unit is arranged for preparing said screen cloth for optical inspection in said optical inspection station, the optical inspection station, comprising:

a camera arranged for making an image capture of one or more damaged portions;

a camera memory for storing said image capture; and a measuring device comprising a computer with an algorithm for retrieving said image capture, and for analysing and registering said damaged portions position and extent and degree of damage, said computer being further arranged for registering data of said damaged portions position and extent and degree of damage in a memory of said computer related to a frame number or other identifier for a shaker screen frame holding said screen cloth, said subsequently arranged repair unit is arranged for mending one or more damaged portions, and said feeding out transport device is configured to feed out said repaired screen cloth from the subsequently arranged repair unit back to the stacking station for storage.

2. The apparatus according to claim 1, wherein said preparation unit comprises a dryer unit.

3. The apparatus according to claim 1, wherein said plurality of stacking racks define a plurality of slots arranged for receiving the cleansed, inspected and if damaged, repaired screen cloths in available free slots in the stack.

4. The apparatus of claim 1, wherein said camera is an area camera capturing an image capture of the entire screen cloth or an area portion of said screen cloth.

5. The apparatus of claim 1, wherein said camera is a line camera scanning said screen cloth line by line and arranged for reconstructing said image capture from said lines.

6. The apparatus of claim 1, wherein said algorithm is further arranged for analysing and registering the degree of wear of said damaged portions.

7. The apparatus of claim 1, wherein said cleansing unit comprises a flushing unit for flushing liquid or steam onto an upper and lower face of said screen cloth.

8. The apparatus of claim 1, wherein said cleansing unit comprises a vibrating unit arranged for vibrating said screen cloth during a cleansing process.

9. The apparatus of claim 7, wherein said flushing unit comprises a rotating arm with nozzles directed at least towards one face of said screen cloth.

10. The apparatus of claim 1, wherein said identifier is comprised in a RFID-tag.

11. The apparatus of claim 1, wherein said algorithm is arranged for relating said data to the identifier of the frame number of the screen cloth and the actual drilling depth interval of use.

12. The apparatus of claim 1, wherein said algorithm is arranged for relating said data to the identifier of the frame number of the screen cloth and the actual drilling depth interval of use, registered real conditions, and further for calculating a cut point curve or particle size distribution for said screen cloth after the repair has been made.

13. A method for cleansing and monitoring wear of used or drilling liquid contaminated screen cloths used in a petroleum drilling process comprising the steps of:

feeding in said screen cloths one by one from a stacking station to a cleansing unit using a combined feeding in transport device and feeding out transport device, the stacking station being configured to stack said screen cloths in a stack and including a plurality of stacking racks configured for storage of more than one of said screen cloths, said combined feeding in transport device and feeding out transport device comprising actuators, sheaves and guide rails configured to displace and guide frames with screen cloths from said stacking station to the cleansing unit;

cleansing said screen cloth in a cleansing unit;

preparing said cleansed screen cloth for optical inspection in a preparation unit;

inspecting optically said screen cloth in an optical inspection station, comprising the steps of:

using a camera making an image capture;

storing said image capture in a camera memory; and measuring using a measuring device, the measuring device comprising a computer with an algorithm retrieving said image capture, said algorithm measuring and analysing said image capture for damaged portions position and extent and degree of damage, and registering said damaged portions position and extent and degree of damage in said a memory of the computer under an identifier of said screen cloth;

repairing, a subsequently arranged repair unit, said damaged portions and registering resulting repaired portions' extent to said computer memory related to a frame number or other identifier for a shaker screen frame holding said screen cloth; and feeding out said repaired screen cloth using said feeding out transport device from the subsequently arranged repair unit back to the stacking station for storage, wherein the stacking station, the cleansing unit, the preparation unit, the optical inspection station and the subsequently arranged repair unit are accommodated within a housing.

14. The method according to claim 13, wherein the damaged portions position is registered relative to a given origin on the screen cloth or said shaker screen frame.

15. The method according to claim 14, wherein said damaged portions position is registered as a position (7*x*, 7*y*) from an origin on said screen cloth.

16. The method according to claim 15, wherein said position (7, 7*x*, 7*y*) is registered according to the actual cell frame in said shaker screen frame.

17. The method according to claim 13, wherein said step of preparing further comprises drying of said screen cloth to remove a liquid film remaining from said cleansing process.

18. The method of claim 13, wherein said step of measuring further comprises measuring the damaged portions' diameter or area.

19. The method of claim 18, wherein the step of measuring further comprises measuring a shape of the damaged portions.

20. The method of claim 13, wherein said step of measuring further comprises measuring a degree of wear or damage or possible breakage of said damaged portions.

21. The method according to claim 13, wherein said screen cloth is fed back to said stacking station using said feed out unit.

22. The method of claim 13, wherein said stacking station is used both for feeding in said screen cloths to said cleansing unit and for receiving said cleansed, repaired and inspected screen cloths.

23. The method of claim 13, further comprising the step of after registering said repaired portions' extent, measuring and registering the repaired portions degree of permeability or cut-point and the accumulated repaired portions mended area and remaining intact area of said screen cloth.

24. The method of claim 13, further comprising the step of sending said repaired screen cloth back to said optical inspection station and measuring the repaired portions extent.

25. The method of claim 13, further comprising the step of registering the current drilling depth interval for which said screen cloth was used, and possibly the time of occurrence of said damage.

26. The method of claim 13, further comprising the step of said algorithm further calculating said damaged portions' diameter or area and registering said diameter or area.

27. The method of claim 13, further comprising the step of arranging said identificatior for said screen cloth on said frame.

* * * * *